US006595679B2

(12) United States Patent
Schuchardt

(10) Patent No.: US 6,595,679 B2
(45) Date of Patent: Jul. 22, 2003

(54) STATIC MIXER WITH AT LEAST THREE INTERLEAVED GRIDS

(75) Inventor: Heinrich Schuchardt, Leverkusen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 141 days.

(21) Appl. No.: 09/778,690

(22) Filed: Feb. 7, 2001

(65) Prior Publication Data

US 2001/0012235 A1 Aug. 9, 2001

(30) Foreign Application Priority Data

Feb. 8, 2000 (DE) ..... 100 05 457

(51) Int. Cl.[7] ..... B01F 5/06
(52) U.S. Cl. ..... 366/147; 366/337
(58) Field of Search ..... 366/147, 181.5, 366/336, 337, 340; 48/189.4; 138/37, 40, 42; 55/442–444; 261/108, 112.2

(56) References Cited

U.S. PATENT DOCUMENTS

| | | | | |
|---|---|---|---|---|
| 3,827,676 | A | * | 8/1974 | Brasie |
| 4,062,524 | A | | 12/1977 | Brauner et al. |
| 4,072,296 | A | * | 2/1978 | Doom |
| 4,211,277 | A | * | 7/1980 | Grosz-Roll et al. |
| 4,220,416 | A | * | 9/1980 | Brauner et al. |
| 4,692,030 | A | * | 9/1987 | Tauscher et al. |
| RE34,255 | E | * | 5/1993 | Friedrich |
| 5,378,063 | A | * | 1/1995 | Tsukada |
| 5,484,203 | A | * | 1/1996 | King et al. |
| 5,564,827 | A | * | 10/1996 | Signer |
| 5,620,252 | A | * | 4/1997 | Maurer |
| 5,688,047 | A | * | 11/1997 | Signer |
| 5,865,537 | A | * | 2/1999 | Streiff et al. |
| 6,217,208 | B1 | * | 4/2001 | Schuchardt |
| 6,394,644 | B1 | * | 5/2002 | Streiff |
| 6,412,975 | B1 | * | 7/2002 | Schuchardt et al. |

FOREIGN PATENT DOCUMENTS

| | | | | |
|---|---|---|---|---|
| CH | 678284 | * | 8/1991 | ..... 366/337 |
| DE | 2509784 | * | 11/1975 | ..... 366/337 |
| DE | 2522106 | * | 11/1976 | ..... 366/337 |
| DE | 4428813 | * | 2/1996 | ..... 366/337 |
| EP | 727249 | * | 8/1996 | ..... 366/337 |
| EP | 856353 | * | 8/1998 | ..... 366/337 |
| EP | 1067352 | * | 1/2001 | ..... 366/337 |
| GB | 2061746 | * | 5/1981 | ..... 366/337 |
| WO | 99/00180 | * | 1/1999 | ..... 366/337 |

OTHER PUBLICATIONS

VDI–Gesellschaft Kumststaffechnik Jan. 28 and 30, 1986, pp. 348–341, Mischen beim Herstellen und Verarbeiten von Kunststoffen.

* cited by examiner

*Primary Examiner*—Charles E. Cooley
(74) *Attorney, Agent, or Firm*—Joseph C. Gil; John E. Mrozinski; Aron Preis

(57) ABSTRACT

A static mixer is disclosed comprising a mixer insert and an enclosing housing having a central axis. The insert includes at least three interleaved grids and each of the grids includes a plurality of layers that are superposed parallel one to the others. Each of the layers includes a plurality of bars that are mutually parallel one to the others. There is an angle of 30 to 60 degrees between each of the bars and the axis.

17 Claims, 9 Drawing Sheets

STATIC MIXER WITH AT LEAST THREE INTERLEAVED GRIDS

FIELD OF THE INVENTION

The invention relates to a static mixer, comprising at least a mixer insert, possibly a support and possibly a hold-down device, with an enclosing housing, the mixer insert being made up of a multiplicity of interleaved grids of mutually parallel bars arranged in layers lying one above the other, and the grids being arranged with respect to one another in such a way that they are turned by an angle α about the main direction of flow through the mixer.

BACKGROUND OF THE INVENTION

For the mixing of high-viscosity liquids in particular, static mixers are often used. A pump forces the liquid through a tube provided with static mixer internals, the liquid following the axis of main flow being divided into part streams which are swirled and mixed with one another, depending on the type of internals.

The following two devices are mentioned as examples of static mixers:

In the case of the so-called Kenics mixers (see "Mischen beim Herstellen und Verarbeiten von Kunststoffen" [mixing in the preparation and processing of plastics], published by VDI Ges. Kunststofftechnik, VDI-Verlag 1986, pages 238-241), the liquid flow of the product to be mixed is divided into part streams by a separating plate fitted into a tube. The separating plate is twisted about the tube axis. In each of the part streams of the liquid, a turbulent flow is produced, which leads to the liquid being redistributed in the cross section of the tube. Usually, a plurality of such mixing elements are arranged one behind the other in order to keep re-dividing the liquid and to achieve an adequate mixing result. Satisfactory mixing is typically achieved only after 10 to 12 mixing elements.

The also known, so-called SMX mixers (cf. Patent Specification U.S. Pat. No. 4,062,524) comprise two or more mutually perpendicular grids of parallel sheet-metal strips, which are welded to one another at their crossing points and are set at an angle with respect to the main direction of flow of the product to be mixed, in order to divide the liquid into part streams and mix it. The manufacturing effort for these mixers is very high because of the many weld connections to be made. An individual mixing element is unsuitable as a mixer, since thorough mixing only takes place along a preferential direction transversely with respect to the main direction of flow. Therefore, a plurality of mixing elements which are turned through 90° with respect to one another must be arranged one behind the other. Really thorough mixing typically requires 5 to 6 mixer elements arranged one behind the other.

This can be explained as follows: an SMX mixer has only two grids of parallel bars turned through 180° with respect to each other. These grids comprise layers of equidistant bars. Neighbouring layers are arranged in line with one another. Each layer represents a plane of symmetry which is not crossed during mixing.

DETAILED DESCRIPTION OF THE INVENTION

The object of the invention is to provide a static mixer which surpasses the mixing effect of the known mixers, in particular of the SMX mixer, and can be produced with minimal production effort.

The object is achieved according to the invention by a static mixer comprising at least a housing with possibly a support and possibly a hold-down device and with a mixer insert comprising at least three grids of parallel bars which are turned with respect to one another about the direction of flow and are set with respect to the direction of flow.

The subject matter of the invention is a static mixer comprising at least a mixer insert, possibly a support and possibly a hold-down device, with an enclosing housing, the mixer insert being made up of at least three interleaved grids of mutually parallel bars arranged in layers lying one above the other, and the grids being arranged with respect to one another such that they are turned by an angle α about the main direction of flow through the mixer.

In the case of this design, the bars of one grid can be kept in their position by the bars of the other grids without having to be connected to one another. Therefore, with this type of design no additional effort is required for welding the bars together.

On account of the arrangement according to the invention there is no plane of mirror symmetry, so that the mixing effect takes place biaxially.

A preferred configuration of the static mixer is characterized in that the bars are set at an angle β preferably of 30 to 60° with respect to the main direction of flow through the mixer.

In a preferred variant of the static mixer, the bars of one grid are fixed in their position by the bars of the other grids, the housing and, in the case of the bars at the ends, by the support and/or the hold-down device.

The number of grids of the mixing insert of the static mixer is preferably three or four.

It is particularly preferred for the static mixer to be constructed in a rotationally symmetrical manner corresponding to the number of grids.

A preferred configuration of the static mixer is characterized in that three grids with parallel bars are constructed from parallel layers of bars, respectively neighbouring layers being staggered with respect to one another.

Another preferred configuration of the static mixer is characterized in that four grids with parallel bars are constructed from parallel layers of bars, neighbouring layers being in line with one another.

In a further preferred form of the static mixer, neighbouring grid planes of a grid are arranged offset with respect to one another and the number of grids is four.

If the static mixer is also to be used as a heat exchanger, the bars may be designed as hollow bars which open out in the housing wall, the housing wall having an enclosure divided into a plurality of chambers, with discharge lines and supply lines for a heat transfer medium.

Further subject matter of the invention is the use of the static mixer according to the invention for the mixing of high-viscosity products to be mixed, in particular polymer melts or polymer solutions with additives, other polymers, dyes, pigments or stabilizers.

The invention is further explained below by the examples, which however do not represent any restriction of the invention, on the basis of the figures, in which:

EXAMPLES

Example 1

Figure 1A:
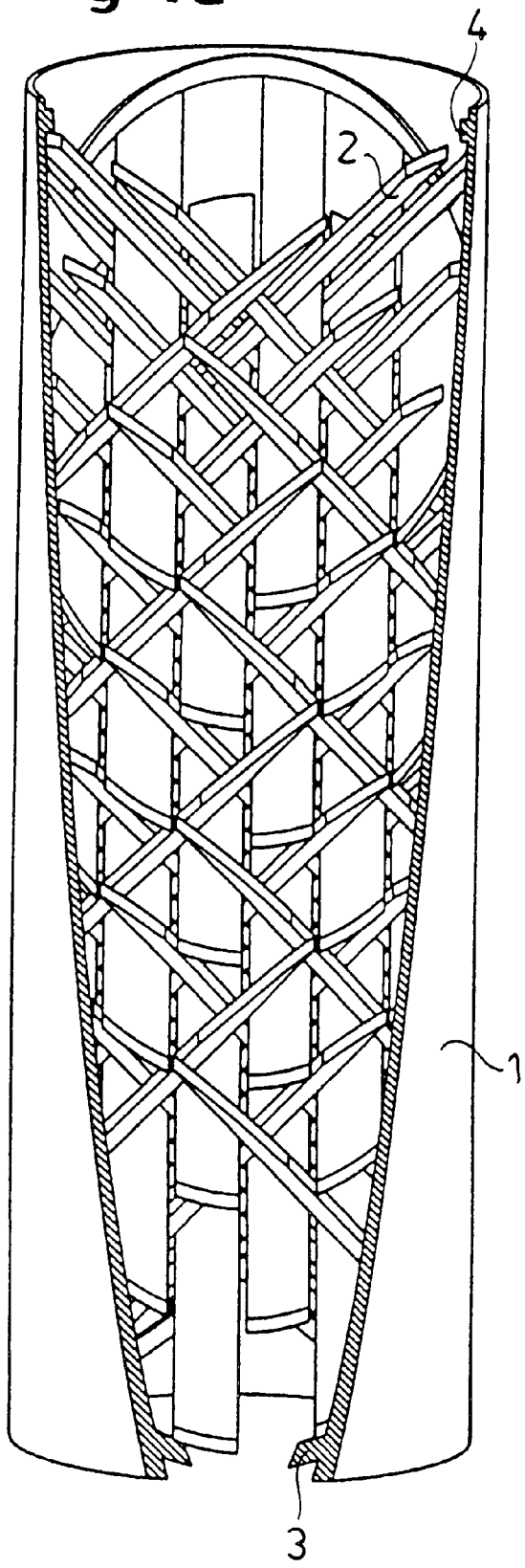
FIG. 1*a* shows a mixer according to the invention in a perspective view, in which the housing is represented in section

In FIG. 1*a*, a static mixer according to the invention is represented in a perspective view; the housing 1 is in this case represented in section.

Figure 1B:
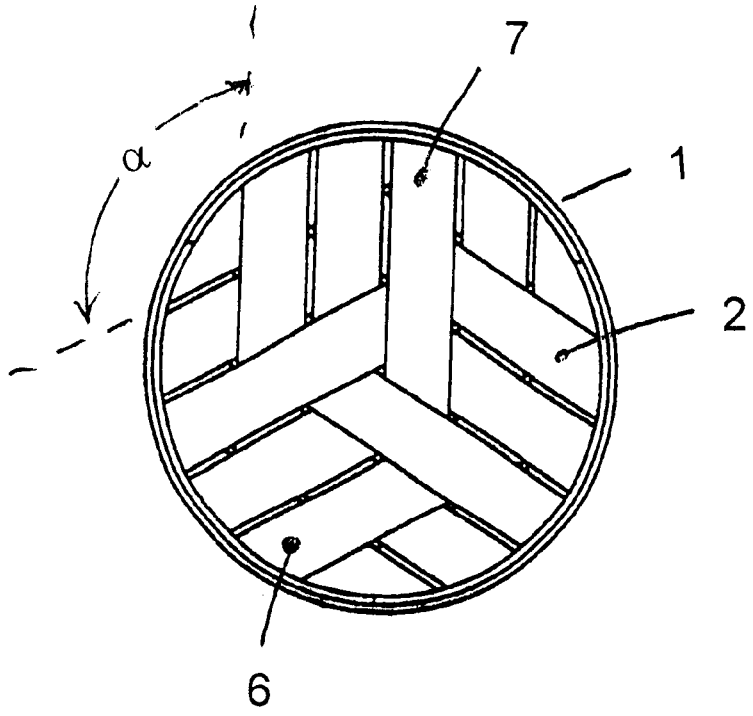
FIG. 1*b* shows the mixer from FIG. 1*a* in plan view

In the plan view of the mixer according to FIG. 1*b*, it can be seen that the mixer is constructed with threefold rotational symmetry about the mixing of the flow.

Figure 2:
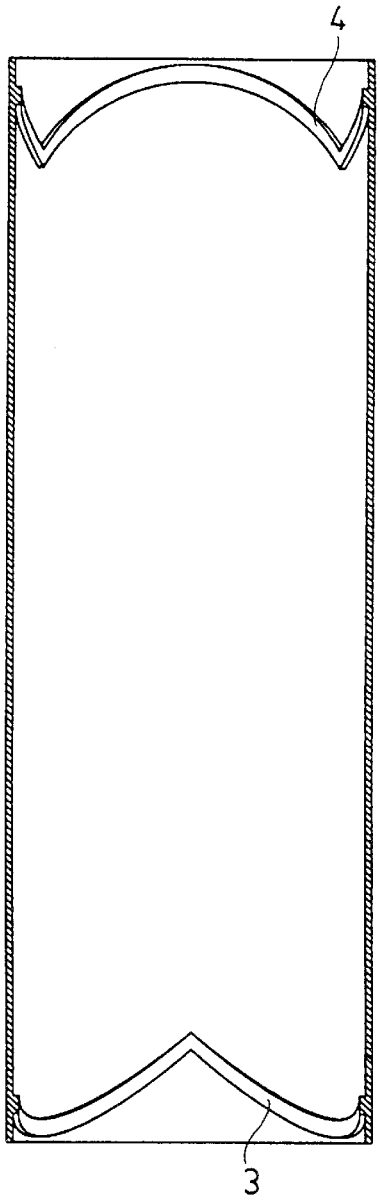
FIG. 2 shows the housing of the mixer from FIG. 1 in longitudinal section

In the longitudinal section of the housing 1 in FIG. 2, the arrangement of the support 3 and of the hold-down device 4 can be seen.

Figure 3:
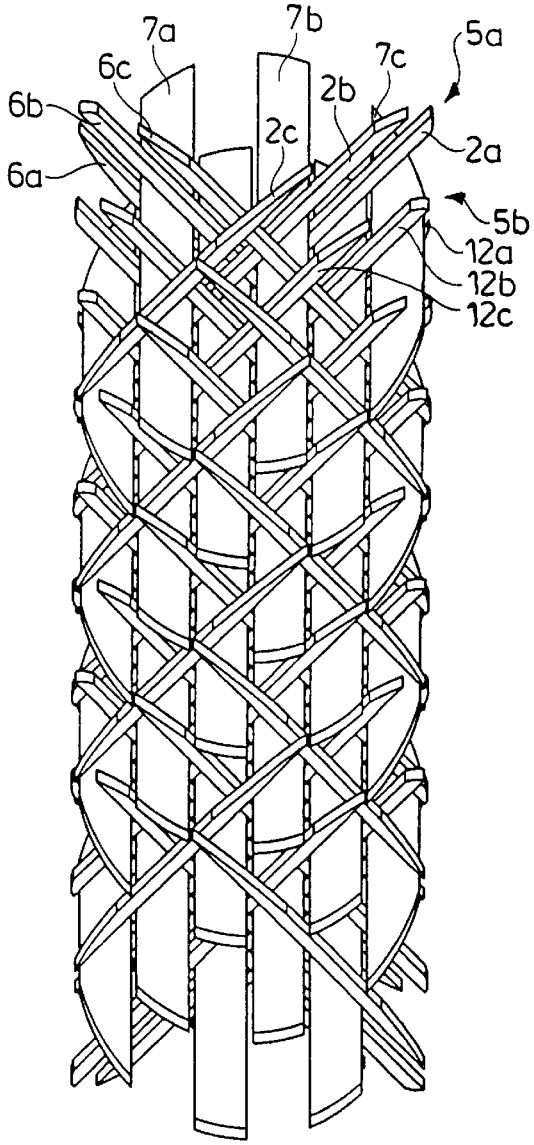
FIG. 3 shows the arrangement of the bars within the mixer from FIG. 1*a* in a perspective view

In the representation of the simple mixer insert according to FIG. 3, it can be seen that three interleaved grids with parallel bars are constructed from parallel layers 5*a*, 5*b* of bars 2*a*, 2*b*, 2*c*; 6*a*, 6*b*, 6*c*; 7*a*, 7*b*, 7*c*, neighbouring layers 5*a* (with the bars 2*a*, 2*b*, 2*c*) and 5*b* (with the bars 12*a*, 12*b*, 12*c*) being staggered with respect to one another.

Figure 4:
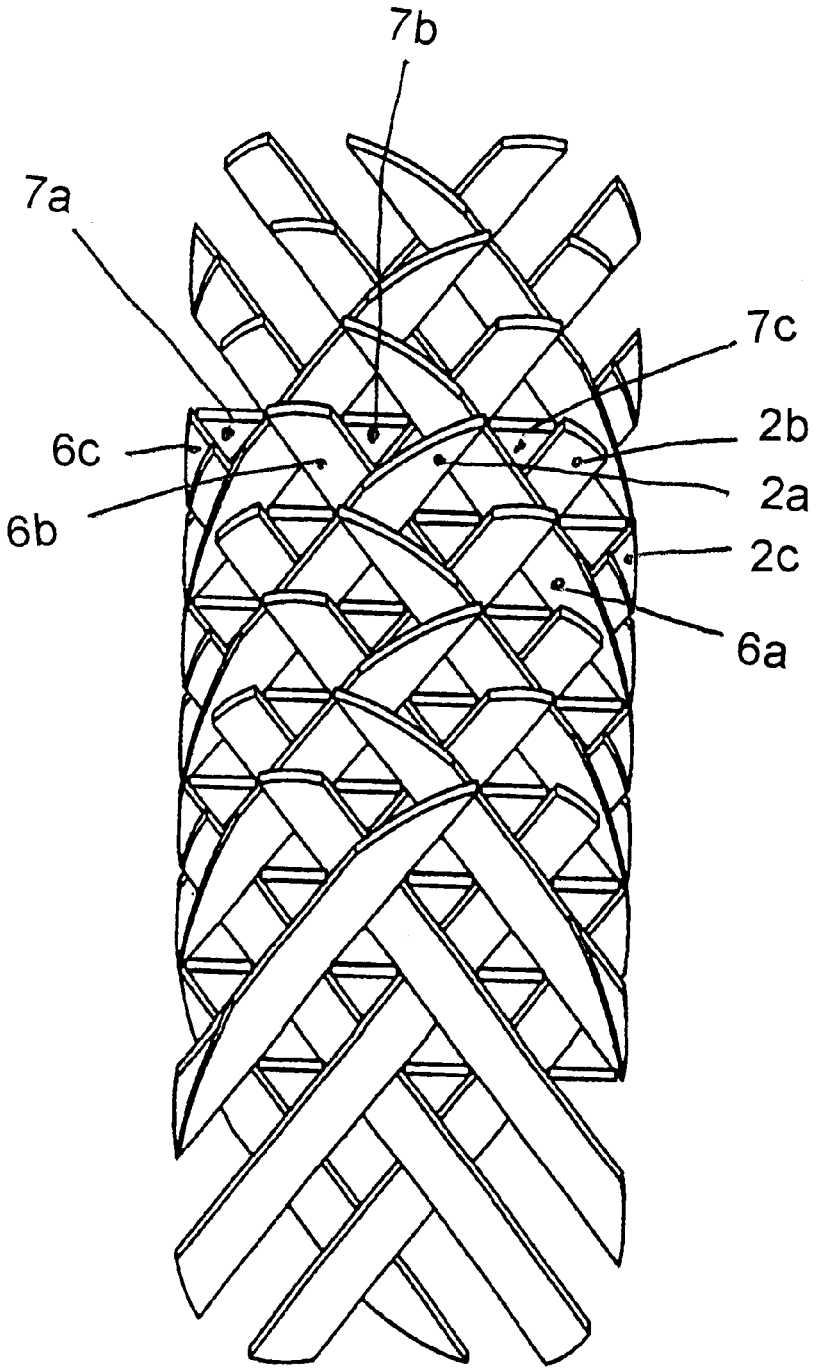
FIG. 4 shows the arrangement of the bars within the mixer from FIG. 1*a* when viewed along the bars

FIG. 4 shows a view along the bars of a grid. It can be seen that the bars 2*a*, 2*b*, 2*c* are fixed in their position by the bars 6*a*, 6*b*, 6*c* and 7*a*, 7*b*, 7*c*, respectively, of the other grids. Only in the uppermost and lowermost layers are bars additionally fixed by the support 3 and the hold-down device 4, respectively (not depicted in FIG. 4).

Example 2

Figure 5:
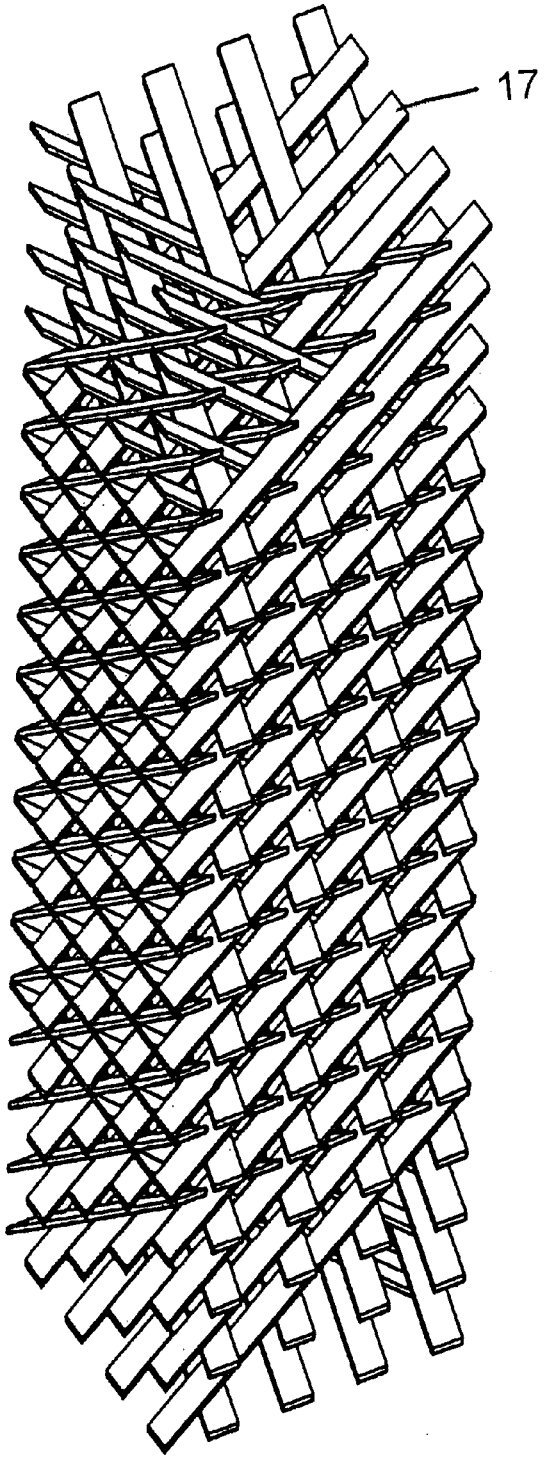
FIG. 5 shows an arrangement of bars for a mixer with a square cross section and with fourfold rotational symmetry

FIG. 5 shows an arrangement of bars for a mixer insert with a square cross section and with fourfold rotational symmetry of the bars with respect to one another. This mixer insert requires a housing 1 of a square cross section.

Example 3

Figure 6:
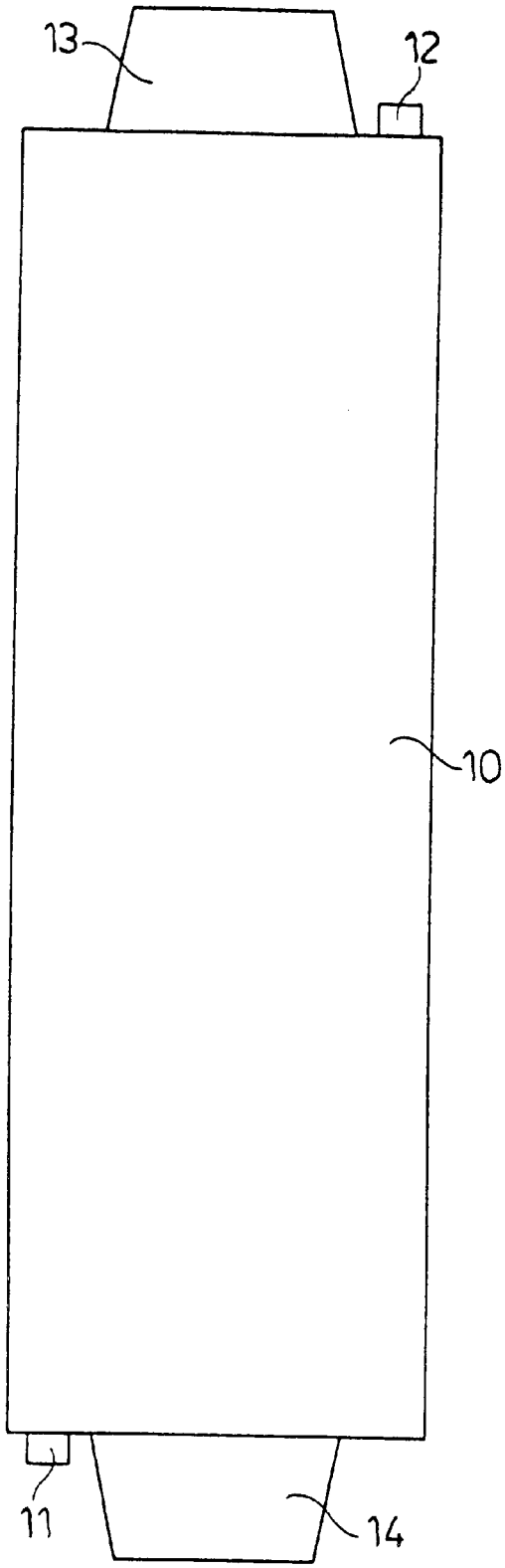
FIG. 6 shows the side view of a mixer according to the invention functioning as a heat exchanger
Figure 7:
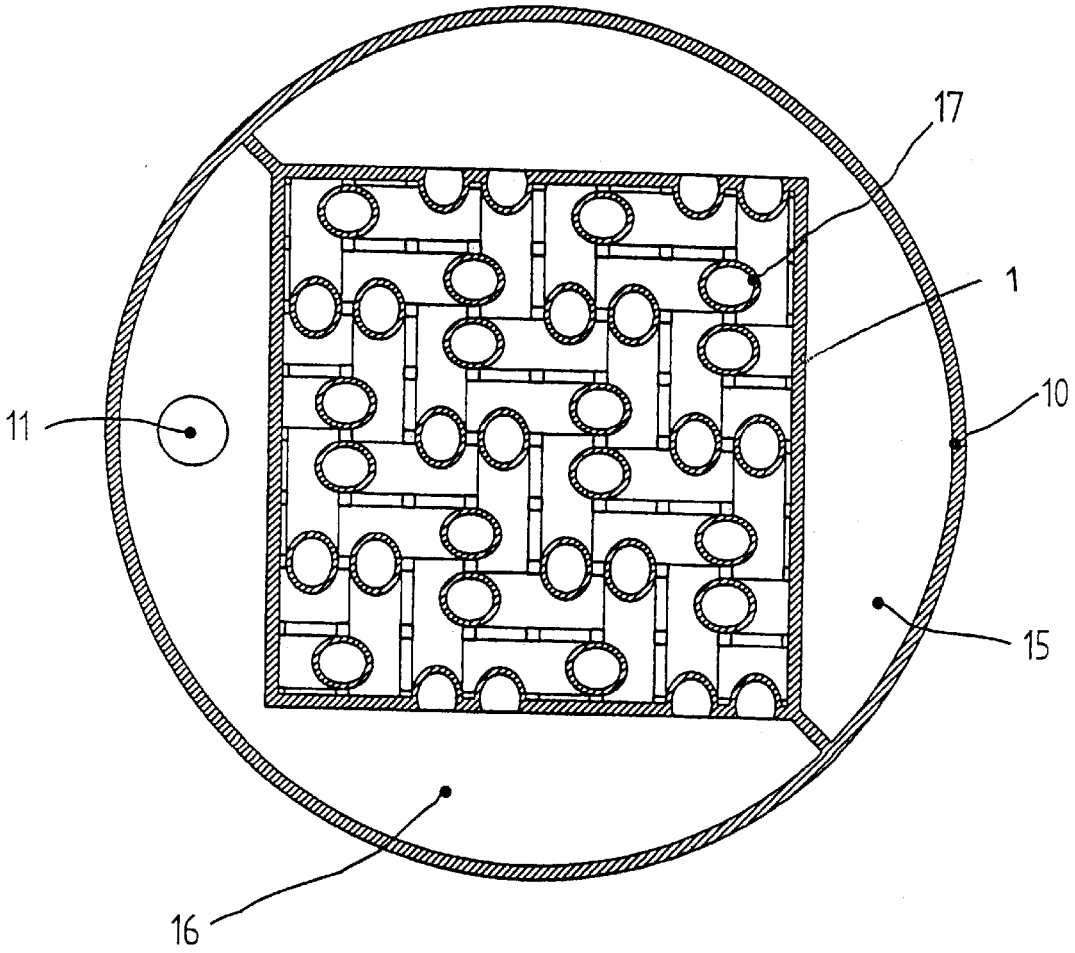
FIG. 7 shows the cross section through the mixer/heat exchanger from FIG. 6
Figure 8:
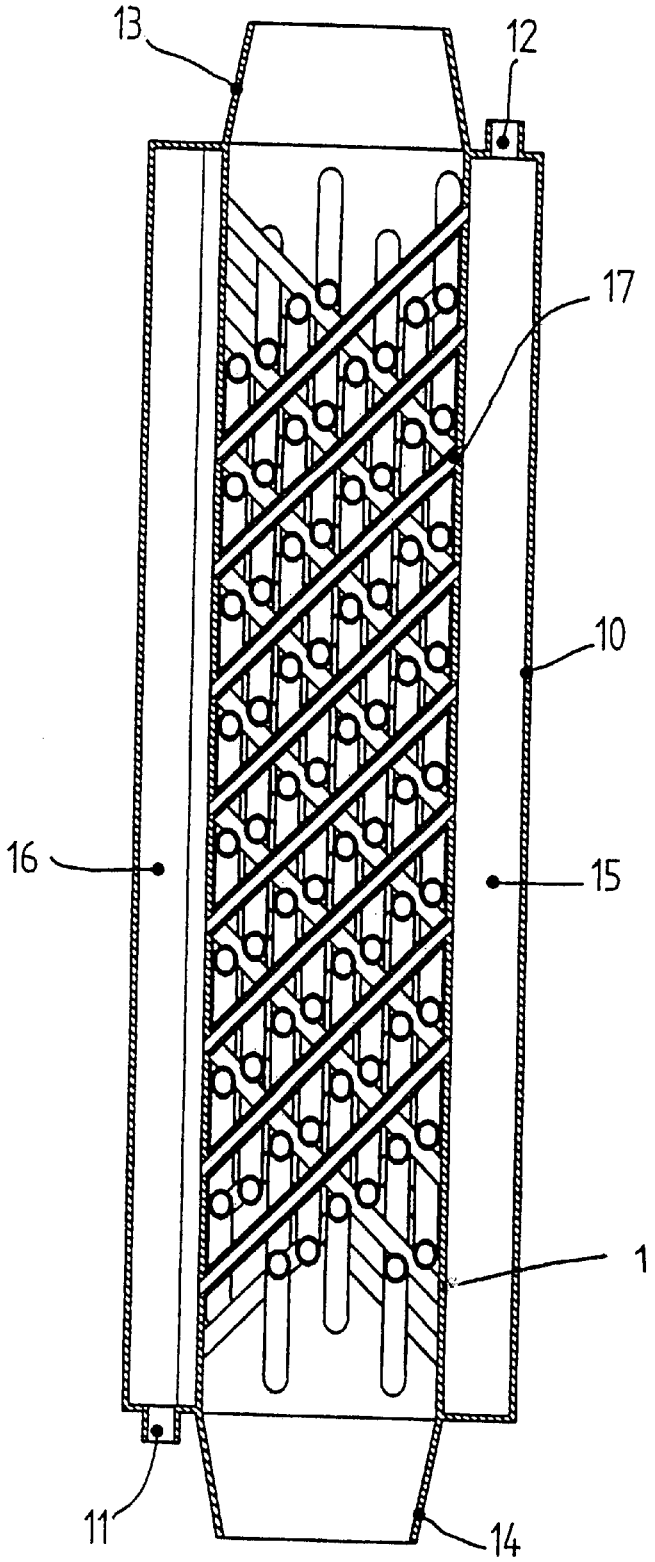
FIG. 8 shows the longitudinal section through the mixer/heat exchanger from FIG. 6
Figure 9:
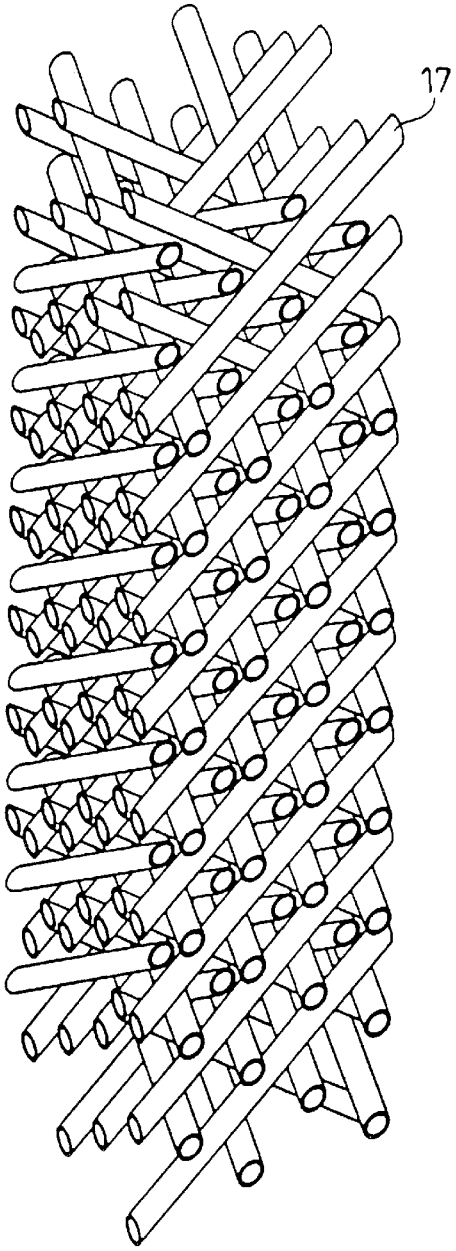
FIG. 9 shows the mixer insert in the mixer/heat exchanger from FIG. 6

FIGS. 6, 7 and 8 show a mixer/heat exchanger comprising an outer housing 10 and an inner housing 1, with a connection piece 13 for supplying the product and a connection piece 14 for discharging the product, and also a supply line 11 and a discharge line 12 for a temperature control medium. Walls between the outer housing 10 and inner housing 1 divide the intermediate space into two chambers 15 and 16 for the supply and discharge lines of the heat transfer medium. FIG. 9 shows the arrangement of the bars 17, designed as tubes, inside the mixer/heat exchanger. It is characterized by four grids with parallel bars, which are arranged such that they are turned with respect to one another by 90° in relation to the direction of flow.

A particularly close tube arrangement is achieved by neighbouring grid planes of a grid being offset with respect to one another.

Example 4

Figure 10:
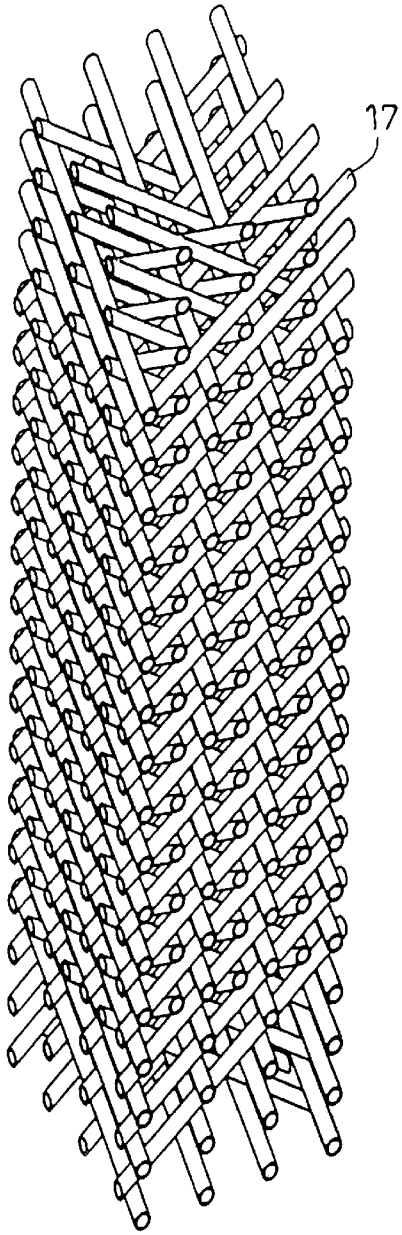
FIG. 10 shows an alternative mixer insert with four grids

FIG. 10 shows an alternative arrangement of the hollow bars of the mixer insert for a mixer/heat exchanger as represented in example 4. Neighbouring grid planes are in line with one another, the number of grids is four.

Such a mixer/heat exchanger is particularly suitable for 2-phase flows. Since the distance between the tubes transversely with respect to the direction of flow is great in comparison with the distance in the main direction of flow, great flow ducts for the product are obtained. The arrangement of the tubes produces a vortical flow in these flow ducts, with separation into a gas flow inside the ducts and a liquid flow on the outer side of the duct. As a result, the pressure loss when flowing through such a mixer/heat exchanger can be kept low.

The foregoing examples of the present invention are offered for the purpose of illustration and not limitation. It will be apparent to those skilled in the art that the embodiments described herein may be modified or revised in various ways without departing from the spirit and scope of the invention. The scope of the invention is to be measured by the appended claims.

What is claimed is:

1. A static mixer comprising:

a mixer insert; and an enclosing housing having a central axis, wherein said insert includes at least three interleaved grids, with each of said grids including a plurality of layers superposed parallel one to the others, and with each of said layers including a plurality of bars mutually parallel one to the others, and wherein said bars are arranged such that an angle of 30 to 60 degrees is formed between each of said bars and said axis.

2. The static mixer of claim 1 further including a support fixing the position of the bars at the ends of the insert.

3. The static mixer of claim 1 further including a hold-down device fixing the position of the bars at the ends of the insert.

4. The static mixer of claim 1, wherein the bars of one grid are fixed in position by the bars of at least two other grids and the enclosing housing.

5. The static mixer of claim 1, wherein the mixer is constructed in a rotationally symmetrical manner corresponding to the number of grids.

6. The static mixer of claim 5, wherein the grids are constructed from parallel layers of bars, and wherein the neighboring layers are in line with respect to one another.

7. The static mixer of claim 5, wherein neighboring grid planes of the grid are staggered with respect to one another.

8. The static mixer of claim 1 wherein the bars are hollow, wherein the wall of the enclosing housing includes a plurality of chambers and wherein said bars are connected with an opening in said wall thereby permitting supply and discharge of a heat transfer medium via said chambers.

9. In a process of mixing a high viscosity member selected from the group consisting of polymer melt and polymer solution, the improvement comprising carrying out the step of mixing in the static mixer of claim 1.

10. A static mixer comprising:

a mixer insert; and an enclosing housing having a central axis, wherein said insert includes three interleaved grids, with each of said grids including a plurality of layers superposed parallel one to the others, and with each of said layers including a plurality of bars mutually parallel one to the others, and wherein said bars are arranged such that an angle of 30 to 60 degrees is formed between each of said bars and said axis.

11. A static mixer comprising:

a mixer insert; and an enclosing housing having a central axis, wherein said insert includes four interleaved grids, with each of said grids including a plurality of layers superposed parallel one to the others, and with each of said layers including a plurality of bars mutually parallel one to the others, and wherein said bars are arranged such that an angle of 30 to 60 degrees is formed between each of said bars and said axis.

12. The static mixer of one of claims 10 and 11, wherein the grids are constructed from parallel layers of bars, and wherein the neighboring layers are staggered with respect to one another.

13. The static mixer of one of claims 10 and 11 further including at least one support fixing the position of the bars at the ends of the insert.

14. The static mixer of one of claims 10 and 11 further including at least one hold-down device fixing the position of the bars at the ends of the insert.

15. The static mixer of one of claims 10 and 11, wherein the mixer is constructed in a rotationally symmetrical manner corresponding to the number of grids.

16. The static mixer of one of claims 10 and 11, wherein the bars are hollow, wherein the wall of the enclosing housing includes a plurality of chambers and wherein said bars are connected with an opening in said wall thereby permitting supply and discharge of a heat transfer medium via said chambers.

17. In a process of mixing a high viscosity member selected from the group consisting of polymer melt and polymer solution, the improvement comprising carrying out the step of mixing in the static mixer of one of claims 10 and 11.

* * * * *